US012680537B2

(12) United States Patent
Wang

(10) Patent No.: US 12,680,537 B2
(45) Date of Patent: Jul. 14, 2026

(54) PUMPING DEVICE

(71) Applicant: Meng-Chun Wang, Taichung City (TW)

(72) Inventor: Meng-Chun Wang, Taichung City (TW)

( * ) Notice: Subject to any disclaimer, the term of this patent is extended or adjusted under 35 U.S.C. 154(b) by 81 days.

(21) Appl. No.: 18/903,201

(22) Filed: Oct. 1, 2024

(65) Prior Publication Data

US 2026/0092599 A1 Apr. 2, 2026

(51) Int. Cl.

| | |
|---|---|
| ***F04B 33/00*** | (2006.01) |
| ***F04B 45/02*** | (2006.01) |
| ***F04B 53/10*** | (2006.01) |

(52) U.S. Cl.

CPC ..... *F04B 33/00* (2013.01); *F04B 45/02* (2013.01); *F04B 53/1072* (2013.01)

(58) Field of Classification Search

CPC ..... F04B 33/00; F04B 45/02; F04B 45/00; F04B 53/1072; F04B 53/16; F04B 39/121; F04B 43/0063; F04B 45/04; F04B 45/045; F16K 15/1402; F16K 15/147; F16K 24/04; F16K 15/16; A43B 21/285; A43B 17/035

USPC ..... 417/472

See application file for complete search history.

(56) References Cited

U.S. PATENT DOCUMENTS

| | | | | |
|---|---|---|---|---|
| 5,372,487 | A * | 12/1994 | Pekar | F16K 15/147 137/846 |
| 2007/0071623 | A1* | 3/2007 | Chang | F04B 33/00 417/480 |
| 2008/0304987 | A1* | 12/2008 | Chang | F04B 45/02 417/472 |
| 2015/0300512 | A1* | 10/2015 | Chen | F04B 33/00 137/223 |
| 2018/0298889 | A1* | 10/2018 | Chang | F04B 53/143 |
| 2020/0217312 | A1* | 7/2020 | Chang | F04B 49/03 |
| 2020/0248679 | A1* | 8/2020 | Hsu | F04B 53/106 |
| 2024/0240724 | A1* | 7/2024 | Chen | F04B 45/02 |
| 2024/0418159 | A1* | 12/2024 | Chang | F04B 33/00 |

FOREIGN PATENT DOCUMENTS

TW I888271 B * 6/2025

* cited by examiner

*Primary Examiner* — Devon C Kramer
*Assistant Examiner* — Kelsey L Stanek
(74) *Attorney, Agent, or Firm* — MUNCY, GEISSLER, OLDS & LOWE, P.C.

(57) ABSTRACT

A pumping device is provided, wherein the pumping device includes: a base including a main body having a base portion, one-way valves and perforations disposed through the base portion, and a cover attached to the base portion, the one-way valves being disposed on the base portion, nozzles being disposed on the base portion for selectably communicating inlet and outlet of the pumping device, the cover covering the base portion to form air passages in communication with the perforations, the cover including at least one through hole selectably in communication with the inlet and an external environment; and an operating unit including a pumping bag and a relief valve which are disposed on the base portion.

10 Claims, 6 Drawing Sheets

PUMPING DEVICE

BACKGROUND OF THE INVENTION

Field of the Invention The present invention relates to pumping device.

Description of the Prior Art

Conventional ways for inflating objects include blowing air with the mouth, using a manual pump, and using an electric pump. Blowing air with the mouth is concerned to hygiene issues and is highly inefficient. Electric pumps have problems such as being heavier, larger, and more costly. Therefore, manual pumps are more commonly used in everyday life.

Conventional manual pumps have disadvantages to be overcome. Although manual pumps are generally lighter and more compact than electric pumps, they are still inconvenient to carry around.

The present invention is, therefore, arisen to obviate or at least mitigate the above-mentioned disadvantages.

SUMMARY OF THE INVENTION

The main object of the present invention is to provide a pumping device which has advantages of being lightweight and compact, is portable, and is convenient to inflate or deflate an object.

To achieve the above and other objects, a pumping device is provided, wherein the pumping device includes: a base including a main body and a cover, the main body including a base portion, a first one-way valve, a second one-way valve, a first perforation, a second perforation and a third perforation, the base portion defining a first side and second side opposite to each other, the first one-way valve and the second one-way valve being disposed on the base portion, the first one-way valve including a first inlet and a first nozzle, the first nozzle being made of an elastic material, the first nozzle being located at the first side and including a first outlet selectably in communication with the first side, a first channel defined by the first nozzle tapering from the second side towards the first side, the first channel being in communication with the first inlet, the second one-way valve including a second inlet and a second nozzle, the second nozzle being made of an elastic material, the second nozzle being located at the first side and including a second outlet selectably in communication with the first side, a second channel defined by the second nozzle tapering from the second side towards the first side, the second channel being in communication with the second inlet, the first perforation, the second perforation and third perforation being disposed through the base portion, the cover being attached to the second side and covering the base portion to form a first air passage and a second air passage, the first air passage being in communication with the first perforation and the second inlet, the second air passage being in communication with the second perforation and the third perforation, the cover including at least one through hole, the through hole being in communication with the first inlet and an external environment; and an operating unit including a pumping bag and a relief valve, the pumping bag being disposed on the base portion and covering the first one-way valve and the first perforation to form a first chamber, the relief valve being disposed on the base portion and covering the second one-way valve and the second perforation to form a second chamber.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
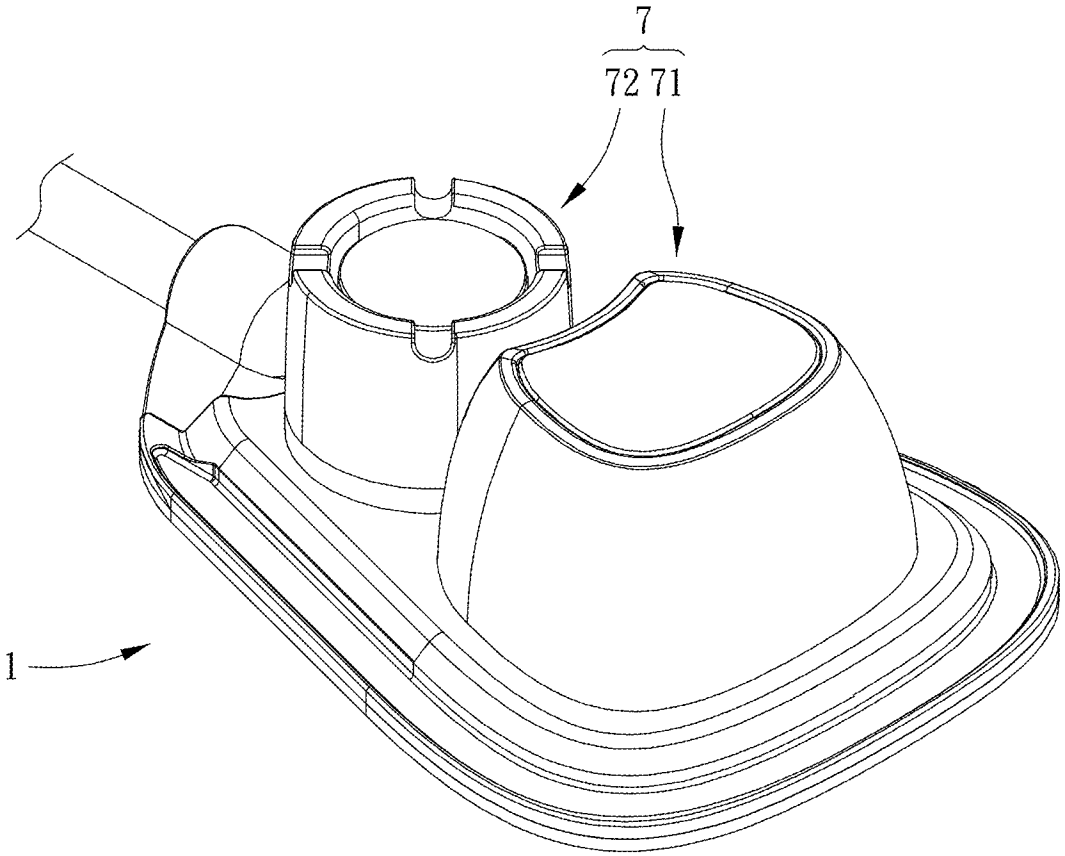
FIG. 1 is a perspective view of an embodiment of the present invention.
Figure 2:
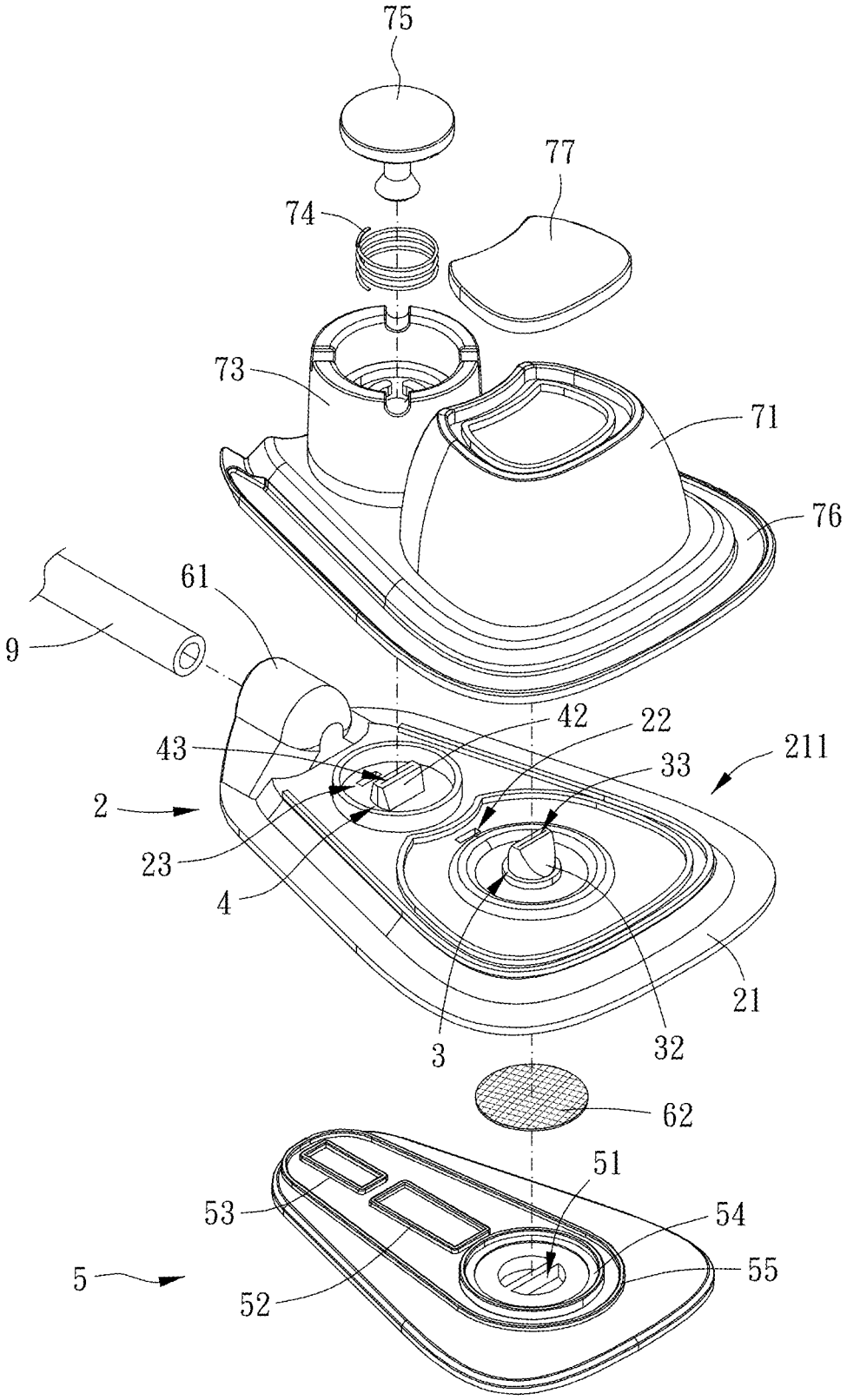
FIG. 2 is an exploded view of FIG. 1.
Figure 3:
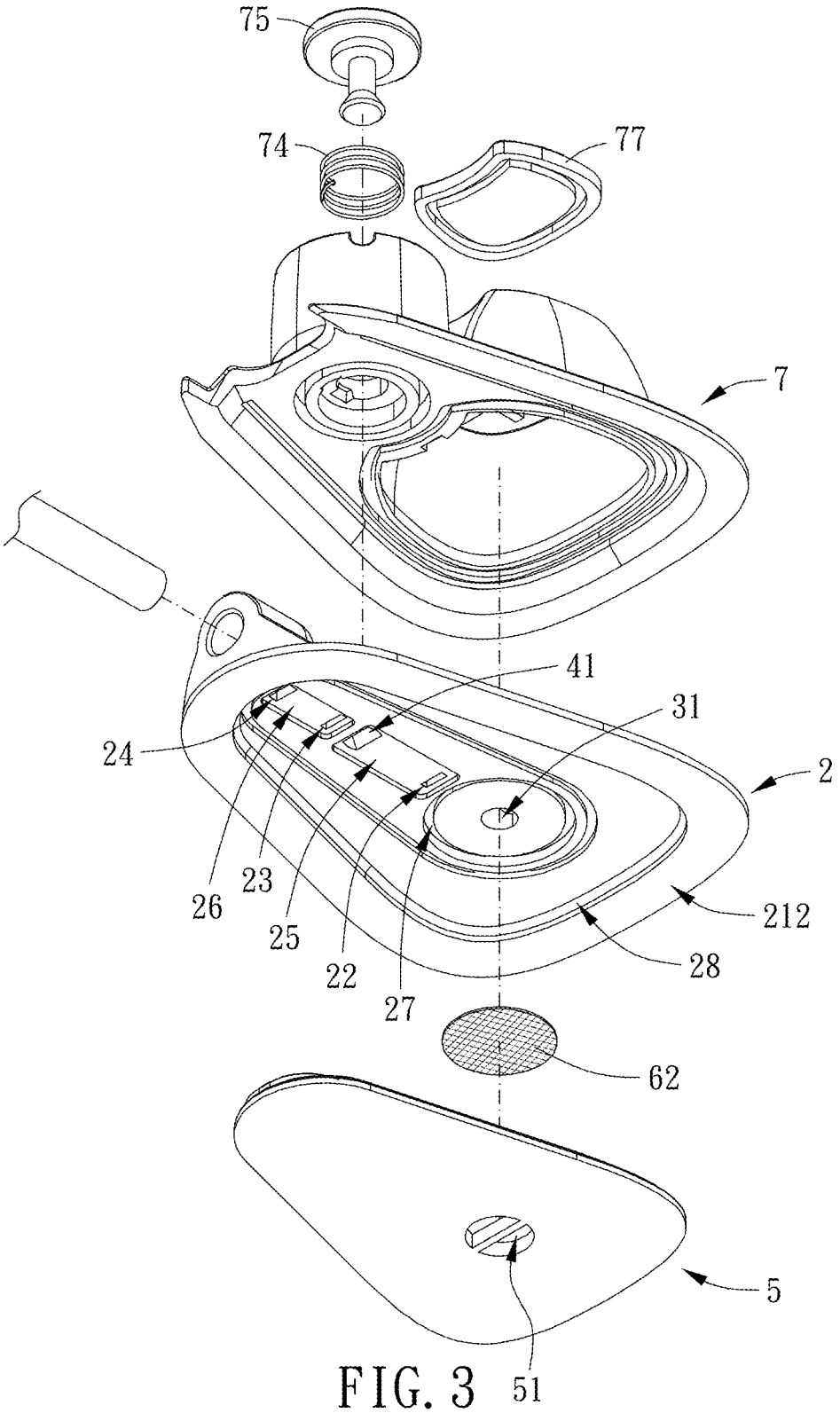
FIG. 3 is another exploded view of FIG. 1.
Figure 4:
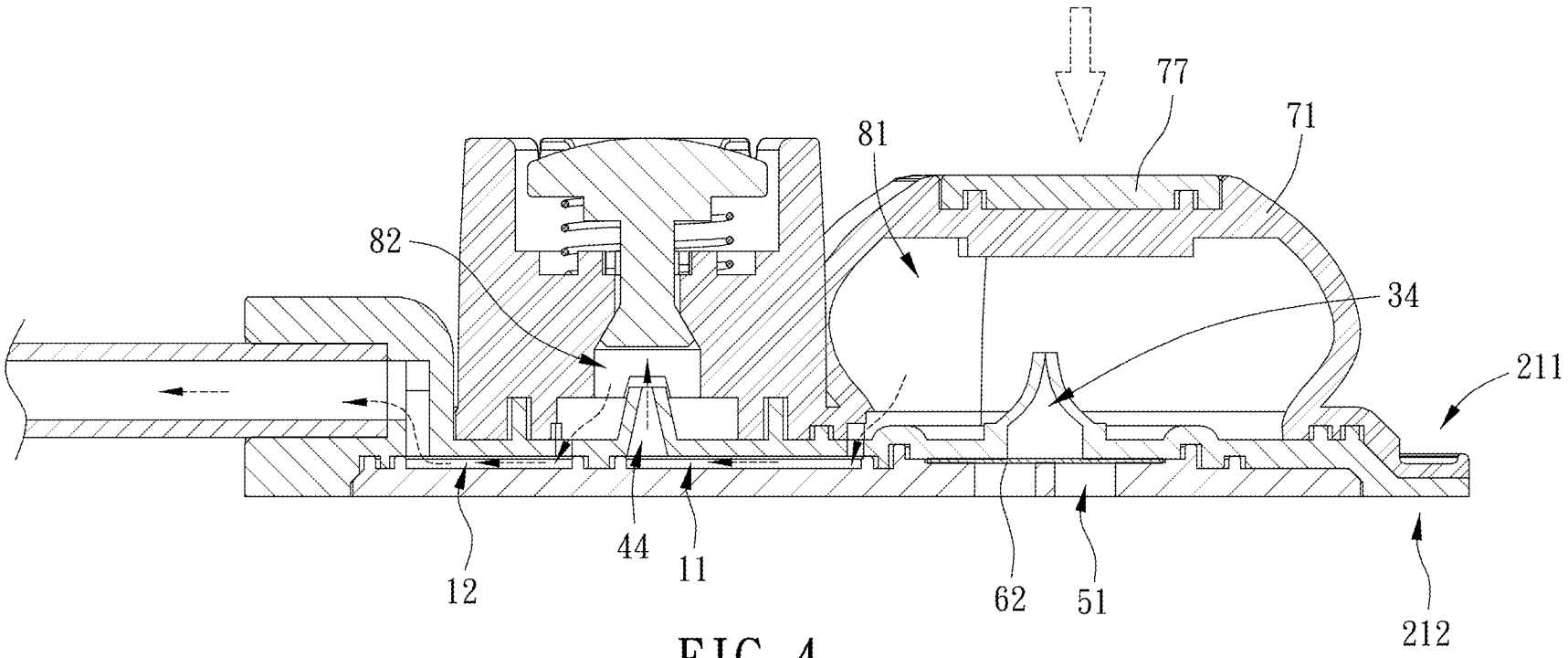
FIG. 4 is a schematic view showing an operation of pressing a pumping bag according to an embodiment of the present invention.
Figure 5:
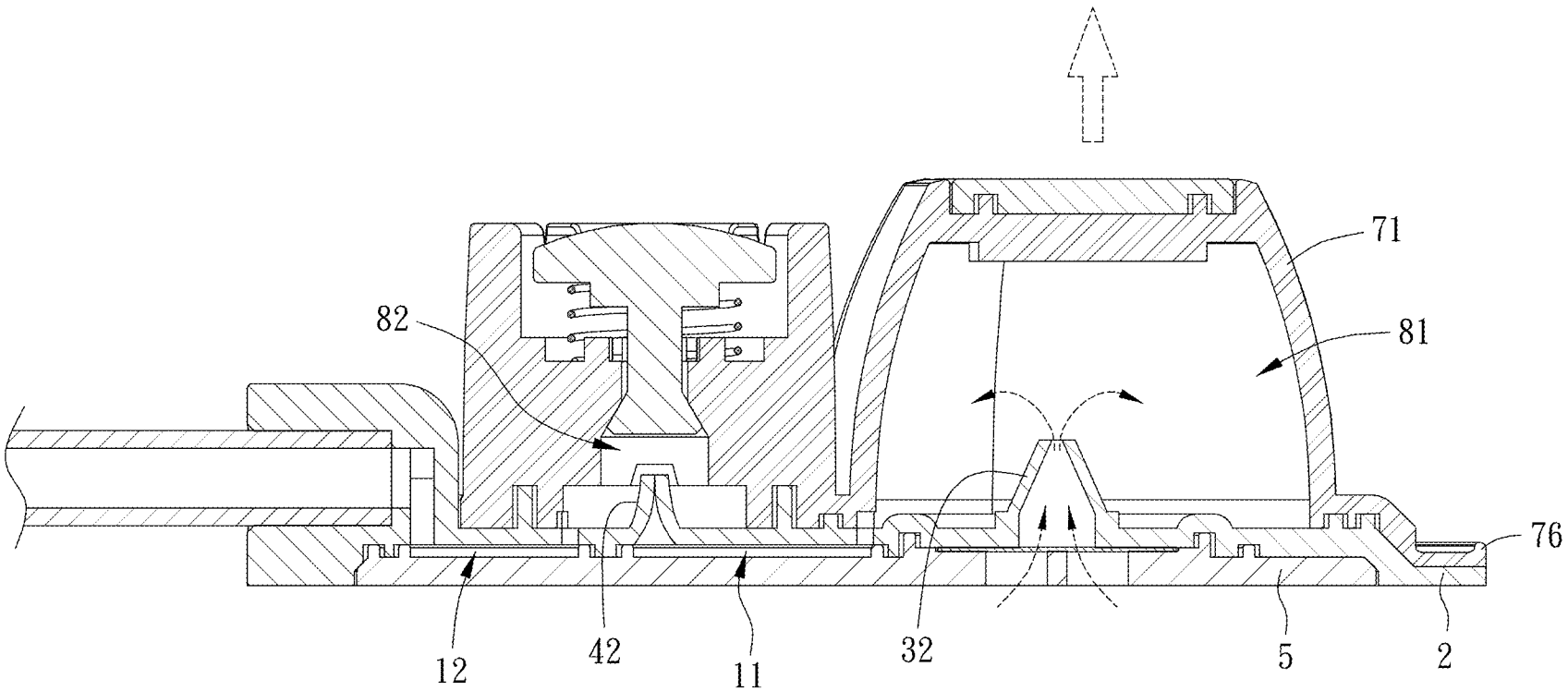
FIG. 5 is a schematic view showing of rebounding of the pumping bag according to an embodiment of the present invention.
Figure 6:
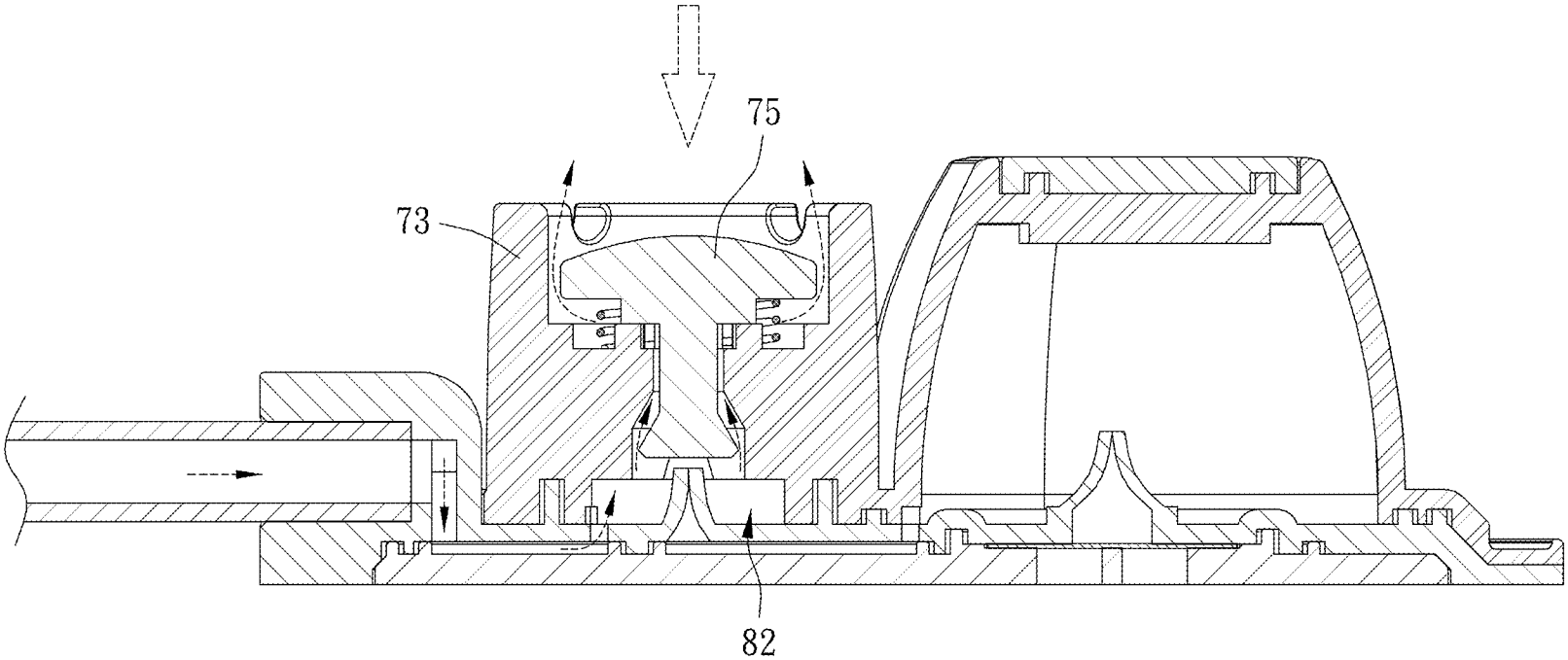
FIG. 6 is a schematic view showing an operation of pressing a relief valve according to an embodiment of the present invention.

Please refer to FIGS. 1 to 6 for an exemplary embodiment of the present invention. A pumping device of the present invention includes a base 1 and an operating unit 7.

The base 1 includes a main body 2 and a cover 5. The cover 5 is embedded within the main body 2. The main body 2 includes a base portion 21, a first one-way valve 3, a second one-way valve 4, a first perforation 22, a second perforation 23, and a third perforation 24.

The base portion 21 defines a first side 211 and a second side 212 opposite to each other. The first one-way valve 3 and the second one-way valve 4 are disposed on the base portion 21.

The first one-way valve 3 includes a first inlet 31 and a first nozzle 32. The first nozzle 32 is made of an elastic material. The first nozzle 32 is located at the first side 211 and includes a first outlet 33 which is selectably in communication with the first side 211. A first channel 34 defined by the first nozzle 32 tapers from the second side 212 towards the first side 211. The first channel 34 is in communication with the first inlet 31. The second one-way valve 4 includes a second inlet 41 and a second nozzle 42. The second nozzle 42 is made of an elastic material. The second nozzle 42 is located at the first side 211 and includes a second outlet 43 which is selectably in communication with the first side 211. A second channel 44 defined by the second nozzle 42 tapers from the second side 212 towards the first side 211. The second channel 44 is in communication with the second inlet 41.

The first perforation 22, the second perforation 23 and the third perforation 24 are disposed through the base portion 21. The cover 5 is attached to the second side and covers the base portion 21 to form a first air passage 11 and a second air passage 12. The first air passage 11 is in communication with the first perforation 22 and the second inlet 41. The second air passage 12 is in communication with the second perforation 23 and the third perforation 24. The cover 5 includes at least one through hole 51, and the through hole 51 is in communication with the first inlet 31 and an external environment.

In this embodiment, as viewed from the first side 211, the first one-way valve 3, the first perforation 22, the second one-way valve 4 and second perforation 23 are linearly arranged and spaced apart on the main body 2. As such, the path of gas flow will be simpler and faster, and the first one-way valve 3 and the second one-way valve 4 are integrally formed on the main body 2 to reduce assembly components and effectively avoid assembly gaps.

The operating unit 7 includes a pumping bag 71 and a relief valve 72. The pumping bag 71 is disposed on the base portion 21 and covers the first one-way valve 3 and the first perforation 22 to form a first chamber 81. The relief valve 72 is disposed on the base portion 21 and covers the second one-way valve 4 and the second perforation 23 to form a second chamber 82. When pumping is performed, the pumping bag 71 is pressed to force the gas in the first chamber 81 through the first perforation 22, the first air passage 11, the second chamber 82, the second perforation 23, the second air passage 12 and the third perforation 24 into the object to be inflated. When the pumping bag 71 rebounds, external air enters the first chamber 81 through the at least one through hole 51 and the first inlet 31. When the relief valve 72 is actuated, the second chamber 82 communicates with the external environment, allowing the internal gas of the inflated object to be discharged to the external environment through the third perforation 24, the second air passage 12, the second perforation 23 and the second chamber 82.

Preferably, a filter 62 is disposed between the cover 5 and the main body 2, and covering the first inlet 31 to filter out larger debris and ensure that only purer gas enters the first chamber 81.

Preferably, the operating unit 7 further includes a press member 77, and the press member 77 is disposed on the pumping bag 71. The press member 77 is harder than the pumping bag 71, allowing it to uniformly distribute pressure applied by a user's fingers across the pumping bag 71.

Preferably, the base 1 further includes a socket 61 which is configured to receive a pipe 9. The socket 61 is disposed on the main body 2 and in communication with the third perforation 24, which allows the pumping device to communicate with an object to be inflated through the pipe 9. In this embodiment, the socket 61 is integrally formed with the base portion 21 to effectively simplify assembly, ensuring structural continuity, and reduce assembly gaps. The socket 61, the pumping bag 71 and the relief valve 72 are located at the first side 211, and a side of the cover 5 opposite to the main body 2 is a flat. This arrangement effectively reduces the occupied height and volume, and when not in use, the pumping device can be stably rested in a flat orientation.

The operating unit 7 further includes a covering portion 76. The relief valve 72 includes a valve seat 73, a spring 74 and an operating member 75. The valve seat 73, the pumping bag 71 and the covering portion 76 are integrally formed of one piece. The operating member 75 is inserted in the valve seat 73 and is movable between a blocking position and a release position. The spring 74 is disposed between the operating member 75 and the valve seat 73 to bias the operating member 75 towards the blocking position. When the operating member 75 is in the blocking position, the operating member 75 discommunicates the second chamber 82 from the external environment. When the operating member 75 is in the release position, the second chamber 82 is in communication with the external environment.

In this embodiment, a side of the main body 2 facing the cover 5 includes a first recess 25 and a second recess 26 which are not in communication with each other and are rectangular. The first perforation 22 and the second inlet 41 are located at the bottom of the first recess 25. The second perforation 23 and the third perforation 24 are located at the bottom of the second recess 26. A side of the cover 5 facing the main body 2 includes a first annular projection 52 and a second annular projection 53. When the cover 5 is disposed on the base portion 21, the first annular projection 52 fits in the first recess 25 to form the first air passage, and the second annular projection 53 fits in the second recess 26 to form the second air passage. This mutually fitting structure can ensure that the gas located in the first communicating air channel 11 and the second communicating air channel 12 will not leak out.

The side of the main body 2 facing the cover 5 further includes a first slot 27 surrounding the first inlet 31. The side of the cover 5 facing the main body 2 further includes a third annular projection 54 surrounding the through hole 51. When the cover 5 is disposed on the base portion 21, the third annular projection 54 fits in the first slot 27, which ensures that the gas flowing through at least one through hole 51 will reliably flow to the first air inlet 31.

Preferably, the side of the main body 2 facing the cover 5 further includes a second slot 28 surrounding the first recess 25 and the second recess 26. The side of the cover 5 facing the main body 2 further includes a fourth annular projection 55 surrounding the first annular projection 52 and the second annular projection 53. When the cover 5 is disposed on the base portion 21, the fourth annular projection 55 fits in the second slot 28, ensuring that the first air passage 11 and the second air passage 12 are not in communication with the external environment.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A pumping device including:

a base including:

a main body, the main body including a base portion, a first one-way valve, a second one-way valve, a first perforation, a second perforation and a third perforation, the base portion defining a first side and second side opposite to each other, the first one-way valve and the second one-way valve being disposed on the base portion, the first one-way valve including a first inlet and a first nozzle, the first nozzle being made of an elastic material, the first nozzle being located at the first side and including a first outlet selectably in communication with the first side, a first channel defined by the first nozzle tapering from the second side towards the first side, the first channel being in communication with the first inlet, the second one-way valve including a second inlet and a second nozzle, the second nozzle being made of an elastic material, the second nozzle being located at the first side and including a second outlet selectably in communication with the first side, a second channel defined by the second nozzle tapering from the second side towards the first side, the second channel being in communication with the second inlet, the first perforation, the second perforation and third perforation being disposed through the base portion; and a cover, the cover being attached to the second side and covering the base portion to form a first air passage and a second air passage, the first air passage being in communication with the first perforation and the second inlet, the second air passage being in communication with the second perforation and the third perforation, the cover including at least one through hole, the through hole being in communication with the first inlet and an external environment; and an operating unit including:

a pumping bag, the pumping bag being disposed on the base portion and covering the first one-way valve and the first perforation to form a first chamber; and a relief valve, the relief valve being disposed on the base portion and covering the second one-way valve and the second perforation to form a second chamber.

2. The pumping device of claim 1, wherein the base further includes a socket, the socket is configured to be connected with a pipe, the socket is disposed on the main body and in communication with the third perforation.

3. The pumping device of claim 2, wherein the socket, the pumping bag and the relief valve are located at the first side, and a side of the cover opposite to the main body is flat.

4. The pumping device of claim 3, wherein the first one-way valve and the second one-way valve are integrally formed on the main body; as viewed from the first side, the first one-way valve, the first perforation, the second one-way valve and second perforation are linearly arranged and spaced apart on the main body; the operating unit further includes a covering portion, the relief valve includes a valve seat, a spring and an operating member, the valve seat, the pumping bag and cover are integrally formed of one piece, the operating member is inserted in the valve seat and is movable between a blocking position and a release position, the spring is disposed between the operating member and the valve seat to bias the operating member towards the blocking position; when the operating member is in the blocking position, the operating member discommunicates the second chamber from the external environment;

when the operating member is in the release position, the second chamber is in communication with the external environment; a side of the main body facing the cover includes a first recess and a second recess which are not in communication with each other, the first perforation and the second inlet are located at a bottom of the first recess, the second perforation and the third perforation are located at a bottom of the second recess, a side of the cover facing the main body includes a first annular projection and a second annular projection, and when the cover is disposed on the base portion, the first annular projection fits in the first recess to form the first air passage and the second annular projection fits in the second recess to form the second air passage; the side of the main body facing the cover further includes a first slot surrounding the first inlet, the side of the cover facing the main body includes a third annular projection surrounding the through hole, and when the cover is disposed on the base portion, the third annular projection fits in the first slot; the side of the main body facing the cover further includes a second slot surrounding the first recess and the second recess, the side of the cover facing the main body includes a fourth annular projection surrounding the first projection and the second annular projection, and when the cover is disposed on the base portion, the fourth annular projection fits in the second slot such that the first air passage and the second air passage are not in communication with the external environment; a filter is disposed between the cover and the main body and covers the first inlet; the socket is integrally formed with the base portion; the cover is embedded within the main body; the first and second recesses are rectangular; the first slot is annular; the operating unit further includes a press member, the press member is disposed on the pumping bag, and the press member is harder than the pumping bag.

5. The pumping device of claim 1, wherein the first one-way valve and the second one-way valve are integrally formed on the main body.

6. The pumping device of claim 1, wherein as viewed from the first side, the first one-way valve, the first perforation, the second one-way valve and second perforation are linearly arranged and spaced apart on the main body.

7. The pumping device of claim 1, wherein the operating unit further includes a covering portion, the relief valve includes a valve seat, a spring and an operating member, the valve seat, the pumping bag and cover are integrally formed of one piece, the operating member is inserted in the valve seat and is movable between a blocking position and a release position, the spring is disposed between the operating member and the valve seat to bias the operating member towards the blocking position, when the operating member is in the blocking position, the operating member discommunicates the second chamber from the external environment, and when the operating member is in the release position, the second chamber is in communication with the external environment.

8. The pumping device of claim 1, wherein a side of the main body facing the cover includes a first recess and a second recess which are not in communication with each other, the first perforation and the second inlet are located at a bottom of the first recess, the second perforation and the third perforation are located at a bottom of the second recess, a side of the cover facing the main body includes a first annular projection and a second annular projection, and when the cover is disposed on the base portion, the first annular projection fits in the first recess to form the first air passage and the second annular projection fits in the second recess to form the second air passage.

9. The pumping device of claim 8, wherein the side of the main body facing the cover further includes a first slot surrounding the first inlet, the side of the cover facing the main body includes a third annular projection surrounding the through hole, and when the cover is disposed on the base portion, the third annular projection fits in the first slot.

10. The pumping device of claim 8, wherein the side of the main body facing the cover further includes a second slot surrounding the first recess and the second recess, the side of the cover facing the main body includes a fourth annular projection surrounding the first projection and the second annular projection, and when the cover is disposed on the base portion, the fourth annular projection fits in the second slot such that the first air passage and the second air passage are not in communication with the external environment.

* * * * *